US006089156A

United States Patent [19]

Stephan

[11] Patent Number: 6,089,156

[45] Date of Patent: Jul. 18, 2000

[54] TURNING DEVICE FOR A PRINTING PRESS

[75] Inventor: Günter Stephan, Wiesloch, Germany

[73] Assignee: Heidelberger Druckmaschinen Aktiengesellschaft, Heidelberg, Germany

[21] Appl. No.: 09/175,718

[22] Filed: Oct. 20, 1998

Related U.S. Application Data

[63] Continuation of application No. PCT/EP97/01424, Mar. 21, 1997.

[51] Int. Cl.[7] ..... B41F 5/02

[52] U.S. Cl. ..... 101/230; 101/409; 271/276; 271/277

[58] Field of Search ..... 101/230, 231, 101/232, 409; 271/276, 277

[56] References Cited

U.S. PATENT DOCUMENTS

| | | | |
|---|---|---|---|
| 4,165,689 | 8/1979 | Giuiuzza | 101/230 |
| 4,723,489 | 2/1988 | Emrich et al. | 101/230 |
| 4,869,166 | 9/1989 | Mathes | 101/230 |
| 5,454,312 | 10/1995 | Helmstaedter et al. | 101/230 |

FOREIGN PATENT DOCUMENTS

| | | |
|---|---|---|
| 0 215 248 | 3/1987 | European Pat. Off. . |
| 0 381 012 | 8/1990 | European Pat. Off. . |
| 30 50 295 C1 | 11/1985 | Germany . |
| 37 17 093 A1 | 12/1988 | Germany . |
| 37 10 257 C2 | 5/1989 | Germany . |
| 37 17 093 C2 | 12/1989 | Germany . |
| 41 26 643 A1 | 2/1993 | Germany . |
| 41 40 762 A1 | 6/1993 | Germany . |

*Primary Examiner*—Eugene Eickholt

*Attorney, Agent, or Firm*—Herbert L. Lerner; Laurence A. Greenberg; Werner H. Stemer

[57] ABSTRACT

A turning device for a printing press, wherein a sheet printed on one side thereof is acceptable from an impression cylinder of an upline printing unit and is transferable to an impression cylinder of a downline printing unit, includes a first gripper device for accepting the sheet by a leading edge thereof from the upline impression cylinder, a register cylinder formed with a multiplicity of suction openings distributed over a circumferential surface thereof and being communicable with a negative pressure source for holding the sheet by suction and for guiding the sheet in-register with a leading edge thereof in the lead, the sheet, while being guided in-register, being held solely by the suction openings, and a second gripper device for accepting the sheet from the register cylinder at a trailing edge of the sheet.

28 Claims, 8 Drawing Sheets

TURNING DEVICE FOR A PRINTING PRESS

CROSS-REFERENCE TO RELATED APPLICATION

This is a continuation of copending International Application PCT/EP97/01424, filed Mar. 21, 1997, which designated the United States.

BACKGROUND OF THE INVENTION

Field of the Invention

The invention relates to a turning device for a printing press, in particular, a sheet-fed offset printing press, having a transfer device disposed between an impression cylinder of a printing unit located upline of the transfer device and an impression cylinder of a printing unit located downline of the transfer device, the transfer device including a first gripper device for accepting a sheet from the impression cylinder of the upline printing unit and including a second gripper device for gripping a trailing edge of the sheet and transferring it to the impression cylinder of the downline printing unit.

For printing both sides of sheetlike material in a sheet-fed offset printing press for perfecting or perfecter printing, i.e., recto and verso printing, after the upper side of the sheet has been printed, it is necessary for the sheet to be turned over by a turning device so that the sheet can then be printed on the rear side thereof.

From the German Published, Non-Prosecuted Patent Application DE-OS 41 26 643, a sheet guiding cylinder for a printing press has become known that has a circumferential surface with many suction bores formed therein, whereon the sheet is held by suction and is smoothed.

In the published German Patent Document DE 37 10 257 C2, there is disclosed a turning device with a storage drum disposed between an upline impression cylinder and a downline impression cylinder, a sheet to be turned being held at a leading edge thereof by a gripper device and at a trailing edge thereof by suction devices on the circumferential surface of the storage drum, a tongs-type gripper device of the downline impression cylinder gripping the trailing edge of the sheet after the latter has passed through gripper central areas between the storage drum and the downline impression cylinder, and has conducted the sheet to a downline printing gap or nip.

In German Patent 30 50 295, a turning device is disclosed wherein a sheet, with its leading edge first, is transferred from an upline impression cylinder to a first gripper device of a transfer drum, the trailing edge of the sheet being held by suction from a suction device against the circumferential surface of the transfer drum, and the trailing edge of the sheet is gripped by a tongs-type turning gripper system, even before the first gripper device releases the leading edge of the sheet. The sheet is then transported, with its leading edge leading, to a suction belt which extends in a curved manner and guides the sheet. Thereafter, the sheet is transferred by its trailing edge from the tongs-type turning gripper device to a downline impression cylinder.

SUMMARY OF THE INVENTION

It is accordingly an object of the invention to provide a turning device for a printing press with which a sheet can be turned safely, reliably and without smearing, with both high precision and high accuracy of registration, and which allows high speed of the printing press both in first-form and perfector printing, i.e., recto and recto/verso printing.

With the foregoing and other objects in view, there is provided, in accordance with a first aspect of the invention, a turning device for a printing press, wherein a sheet printed on one side thereof is acceptable from an impression cylinder of an upline printing unit and is transferable to an impression cylinder of a downline printing unit, comprising a first gripper device for accepting the sheet by a leading edge thereof from the upline impression cylinder, a register cylinder formed with a multiplicity of suction openings distributed over a circumferential surface thereof and being communicable with a negative pressure source for holding the sheet by suction and for guiding the sheet in-register with a leading edge thereof in the lead, the sheet, while being guided in-register, being held solely by the suction openings, and a second gripper device for accepting the sheet from the register cylinder at a trailing edge of the sheet.

In accordance with a second aspect of the invention, there is provided a turning device for a printing press, having a transfer device disposed between an impression cylinder of a printing unit located upline of the transfer device and an impression cylinder of a printing unit located downline of the transfer device, the transfer device including a first gripper device for accepting a sheet from the impression cylinder of the upline printing unit and including a second gripper device for gripping a trailing edge of the sheet and transferring it to the impression cylinder of the downline printing unit, comprising a register cylinder disposed near the transfer device and being formed with a multiplicity of suction openings distributed over a circumferential surface thereof, the suction openings being communicable with a negative pressure source for holding the sheet by suction and guiding the sheet in-register with a leading edge thereof leading, the sheet, while being guided in-register, being held solely by the suction openings, before the second gripper device grips the trailing edge of the sheet.

In accordance with a third aspect of the invention, there is provided a turning device for a printing press, wherein a sheet printed on one side thereof is acceptable from an impression cylinder of an upline printing unit and is transferable turned-over to an impression cylinder of a downline printing unit, comprising a register cylinder having a gripper device disposed thereon for accepting the sheet by a leading edge thereof from an immediately upline impression cylinder and for turning the sheet over, the register cylinder being formed with a multiplicity of suction openings distributed over a circumferential surface thereof and being communicable with a negative pressure source for holding the sheet by suction and guiding the sheet in-register with a leading edge thereof leading, the sheet, while being guided in-register, being held solely by the suction openings, and having a gripper device disposed on the impression cylinder of the downline printing unit for accepting the sheet from the register cylinder at the trailing edge of the sheet.

In accordance with another feature of the invention, the turning device includes an intermediate storage system to which the sheet is transferrable, with the leading edge thereof leading, from the register cylinder.

In accordance with a further feature of the invention, the turning device includes a control device for connecting the suction openings located in a predetermined circumferential surface portion of the register cylinder to the negative pressure source.

In accordance with an added feature of the invention, the circumferential surface portion is capable of assuming a substantially fixed spatial position with respect to the printing press.

In accordance with an additional feature of the invention, the control device includes a stationary, substantially cylindrical core formed with a recess subjectible to action by negative pressure, and a cylinder jacket rotatable about the stationary core and formed with radial through-bores.

In accordance with yet another feature of the invention, the jacket forms the circumferential surface of the register cylinder, and the radial through-bores communicate with the suction openings.

In accordance with yet a further feature of the invention, the cylindrical core is rotatable.

In accordance with yet an added feature of the invention, the control device is formed by a rotary valve disposed on an end face of the register cylinder and connecting the suction openings alternatively with the negative pressure source via chambers disposed in the interior of the register cylinder.

In accordance with yet an additional feature of the invention, the control device is formed by valves triggerable individually and/or in groups and assigned to the suction openings.

In accordance with still another feature of the invention, the register cylinder has a roughened surface.

In accordance with still a further feature of the invention, the turning device includes a further gripper device provided on the register cylinder for accepting the sheet in-register by the leading edge thereof before the sheet is forced by suction onto the circumferential surface.

In accordance with still an added feature of the invention, the circumferential surface portion of the register cylinder is subdivided into further portions separately connectable to the negative pressure source and/or ventilatable.

In accordance with still an additional feature of the invention, the intermediate storage system has a first sheet guiding device communicating with the register cylinder, and is formed of two subsystems having strips meshing in comblike manner with one another.

In accordance with another feature of the invention, at least one of the subsystems has blower nozzles.

In accordance with a further feature of the invention, one of the subsystems has a rounded end portion.

In accordance with an added feature of the invention, the turning device includes a second sheet guiding device disposed between the end portion of the one subsystem and the downline impression cylinder.

In accordance with an additional feature of the invention, the second sheet guiding device is formed by two subsystems meshing with one another in comblike manner, at least one of the subsystems being provided with blower nozzles extending in substantially the direction of the first sheet guiding device.

In accordance with yet another feature of the invention, the second sheet guiding device is formed of first and second subsystems, respectively, with closed surfaces aligned with one another and with blower nozzles let into the surfaces, the first and second subsystems being movable separately and independently of one another along a line parallel to a central axis of the register cylinder.

In accordance with yet a further feature of the invention, the second sheet guiding device has a surface disposed at a spaced distance from the rounded end portion of the first sheet guiding device so that the leading edge of the sheet, on entering the end portion, is lifted by the first sheet guiding device and held by suction by the second sheet guiding device.

In accordance with yet an added feature of the invention, the turning device includes an adjusting device which, upon an adjustment in sheet format, serves to push the first and second subsystems of the first sheet guiding device and the first subsystem and the second subsystem of the second sheet guiding device towards one another so that the spaced distance between the surface of the second sheet guiding device with respect to a reference point on the rounded end portion of the second subsystem of the first sheet guiding device is kept substantially unchanged.

In accordance with yet an additional feature of the invention, the adjusting device includes rollers provided on the first subsystem of the second sheet guiding device, the rollers being guidable in a curved path.

In accordance with still another feature of the invention, the turning device includes a transfer drum located between the upline and the downline impression cylinders, and the first subsystem of the second sheet guiding device, during first form and perfecter printing by the printing press, is movable into a position wherein the blower nozzles extend in the direction of the surface of the transfer drum.

In accordance with still a further feature of the invention, the turning device includes rollers whereon the sheet is guidable, the rollers being provided on at least one of the first and the second sheet guiding devices.

In accordance with still an added feature of the invention, the first sheet guiding device includes a suction belt subjectible to suction, whereon the sheet rests.

In accordance with still an additional feature of the invention, the suction belt is drivable at a speed substantially equivalent to the circumferential speed of the register cylinder.

In accordance with a concomitant feature of the invention, the intermediate storage system includes at least one gripper device for gripping the sheet by the leading edge thereof and guiding the sheet in-register.

The turning device according to the invention thus offers the advantage in particular of turning a sheet with only one transfer drum, without having to store the sheet on the printing cylinder and without having to use discontinuously moved systems. The turning device according to the invention also offers the further advantage that the accelerations acting upon the sheet, and the attendant inertial forces, are comparatively slight in the turning operation, and thus there is less stress on the material and a reduced risk of damage to the sheetlike material.

Other features which are considered as characteristic for the invention are set forth in the appended claims.

Although the invention is illustrated and described herein as embodied in a turning device for a printing press, in particular a sheet-fed offset printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
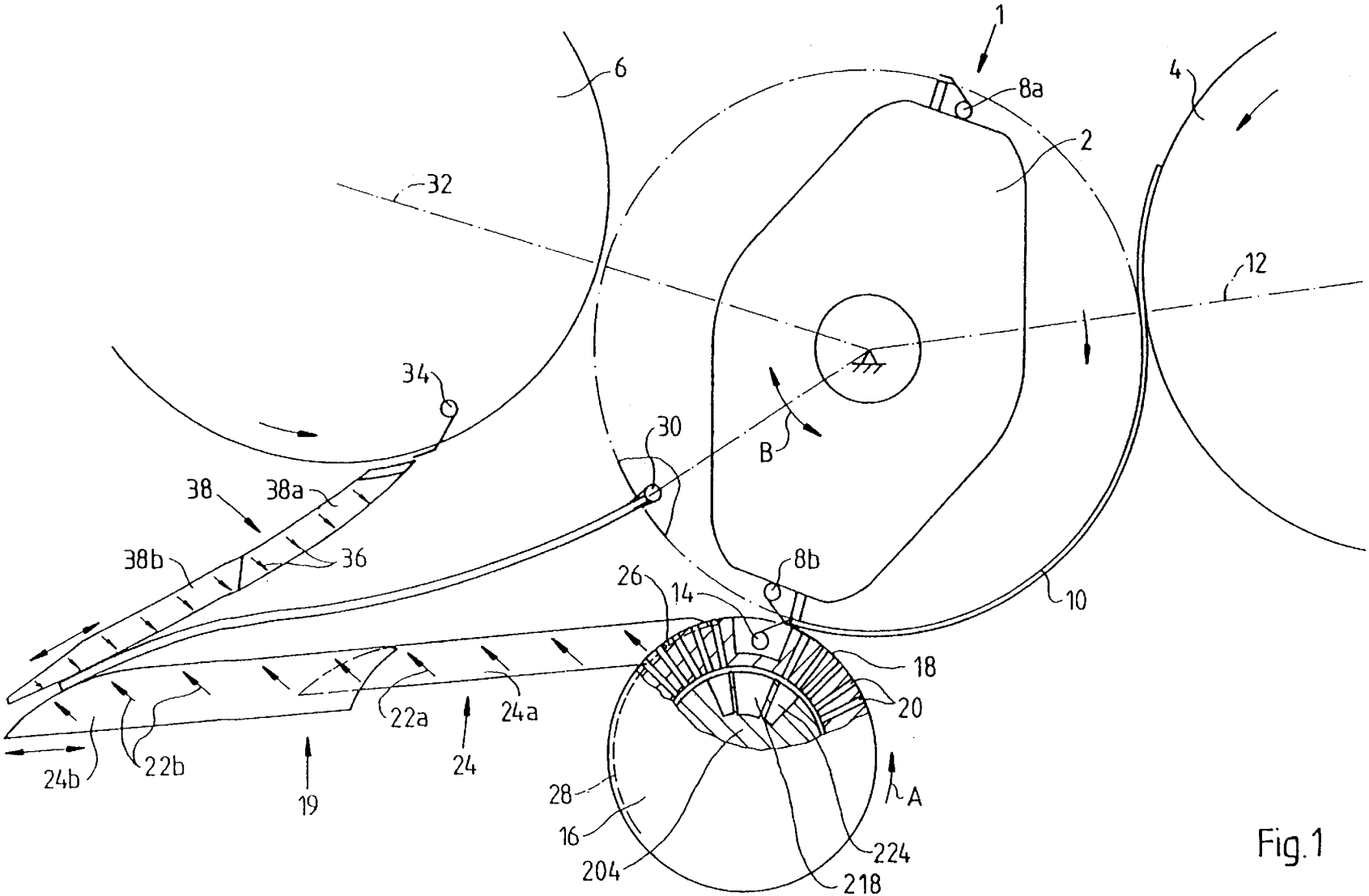
FIG. 1 is a diagrammatic side elevational view of a first embodiment of a turning device according to the invention, with a register cylinder located below a transfer drum and with an intermediate storage system disposed downline of the register cylinder, all shown at the instant of sheet transfer from the transfer drum to the register cylinder.

Referring now to the drawings and, first, particularly, to FIG. 1 thereof, there is shown therein a turning device 1 according to the invention, which includes a transfer drum 2 disposed between a first impression cylinder 4 of an upline printing unit and a second impression cylinder 6 of a downline printing unit. The transfer drum 2 and preferably also the impression cylinders 4 and 6 have a diameter twice that of the rubber blanket cylinder and/or printing plate cylinder associated therewith, but in a further non-illustrated embodiment of the invention, they may also be embodied in the same manner in the form of cylinders of the same size or of multiple size, such as triple or quadruple-sized cylinders, for example. Thus, it is conceivable for the transfer drum 2 to have a diameter three times the size while the impression cylinders 4 and 6 conversely are merely double-sized.

Facing one another, a first and second gripper device 8*a* and 8*b* are provided on the transfer drum 2; they accept a to-be-printed sheet 10 by the leading edge of the sheet in-register from the upline impression cylinder 4 in the region of a central gripper area 12 represented by a dot-dash line or in phantom. The sheet 10 is transported, with its leading edge in the lead, to a register cylinder 16 according to the invention, which is disposed below the transfer drum 2 and has a circumferential surface 18 formed with a multiplicity of suction openings 20 acted upon by suction, the suction openings forcing the sheet by suction onto the circumferential surface 18 of the register cylinder 16 and holding it thereon. The register cylinder 16, in the embodiment of the invention shown in FIGS. 1 and 2, rotates at the same circumferential speed as the transfer drum 2 in the direction of the arrow A, so that the sheet 10 is accepted from the register cylinder 16 in-register and transported onward in-register. Forcing the sheet 10 by suction onto the circumferential surface 18 of the register cylinder 16 additionally and advantageously smoothens the sheet 10 on the cylinder surface 18 and makes it taut, which additionally improves the in-register guidance by the register cylinder 16.

The register cylinder 16 may also have a gripper device 14, shown in FIG. 1 which, in a conventional manner, accepts the leading edge of the sheet 10 in-register from the gripper device 8*a* or 8*b* of the transfer drum 2 and, as a result, still further improvement in the accuracy of registration can be attained upon transfer of the sheet 10 from the transfer drum 2 to the register cylinder 16.

In the preferred embodiment of the invention, the register cylinder 16, after a rotation of the cylinder through an angle of 5° to 60°, for example, transfers the leading edge of the sheet to an intermediate storage system 19.

Figure 2:
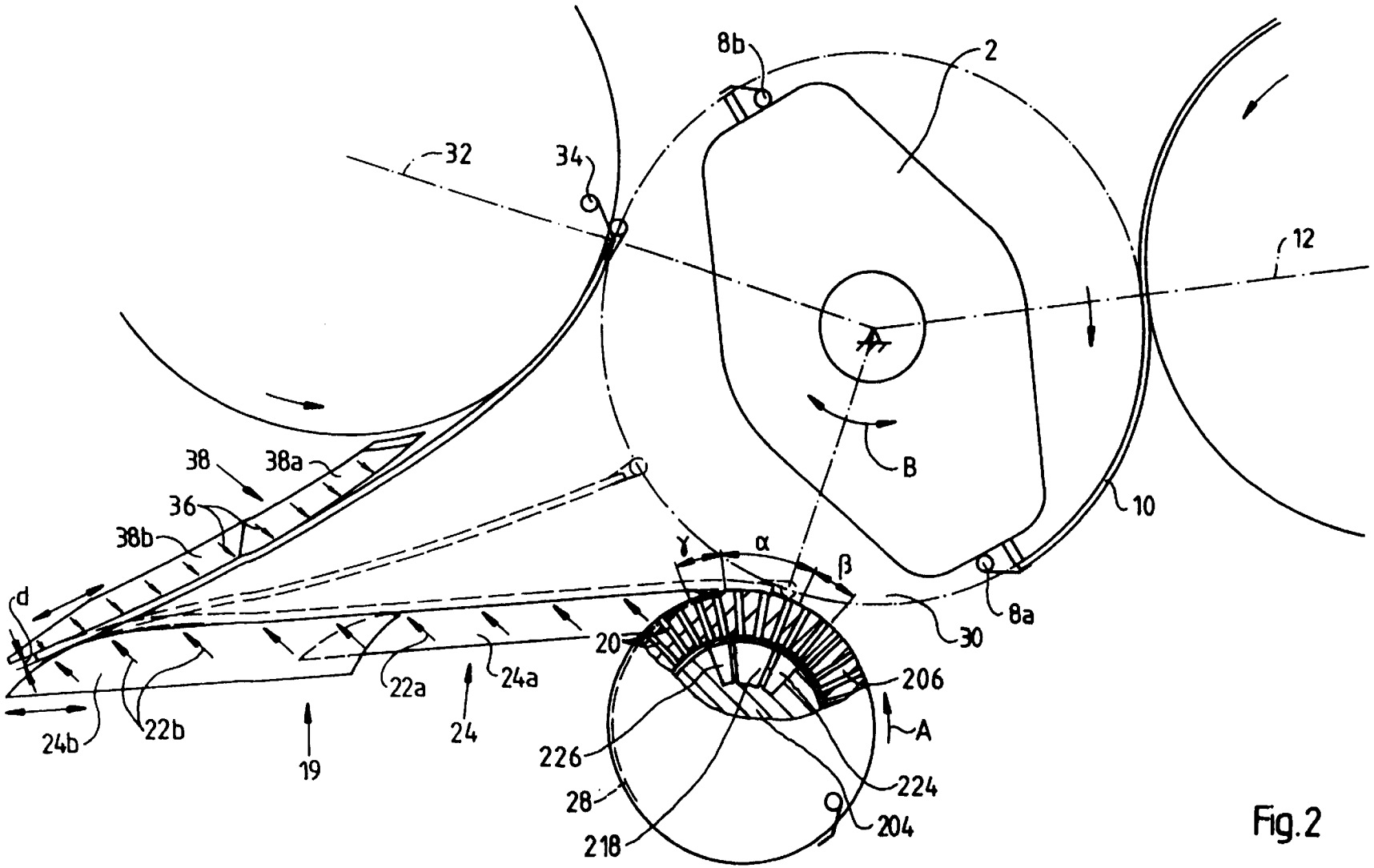
FIG. 2 is a view like that of FIG. 1, in another operating phase wherein the sheet, when the trailing edge thereof is gripped by a tongs-type gripper device of the transfer drum, is guided in-register by the register cylinder into the intermediate storage system.

The intermediate storage system 19 has a first sheet guiding device 24, which is equipped with blower nozzles 22 and on which the sheet is guided in substantially tautened form. In the preferred embodiment, the sheet guiding device 24 has parallel side-by-side comblike protrusions 26, which engage associated grooves or notches 28 formed in the register cylinder 16. This assures a secure stripping of the sheet 10 from the circumferential surface 18 of the register cylinder 18, without causing damage to the leading edge of the sheet as the sheet is being transferred from the register cylinder 16 to the intermediate storage system 19. Due to the blown or blast air emerging from the blower or blast nozzles 22, preferably substantially tangentially to the sheet 10, the latter is held in a well-defined floating state above the sheet guiding device 24, while it is transported by the register cylinder 16 at a substantially constant speed and In-register into the intermediate storage system 19. After the sheet has been placed in tautened form over virtually the entire length thereof onto the sheet guiding device 24 of the intermediate storage system 19, the trailing edge of the sheet 10 is gripped by a turning gripper device 30, heretofore known from the prior art and preferably a tongs-type turning gripper device, as shown in FIG. 2, and the trailing edge of the sheet is lifted progressively, as represented by the broken lines in FIG. 2, from the circumferential surface 18 of the register cylinder or from the sheet guiding device 24. The tongs-type turning gripper device 30 which, as represented by the double-headed arrows B, is adjustable, transfers the trailing edge of the turned or inverted sheet 10 to a conventional gripper device 34 of the downline impression cylinder 6, which transports the turned or inverted sheet to a non-illustrated printing nip of the downline printing unit so that the rear side of the sheet can be printed.

Figure 7:
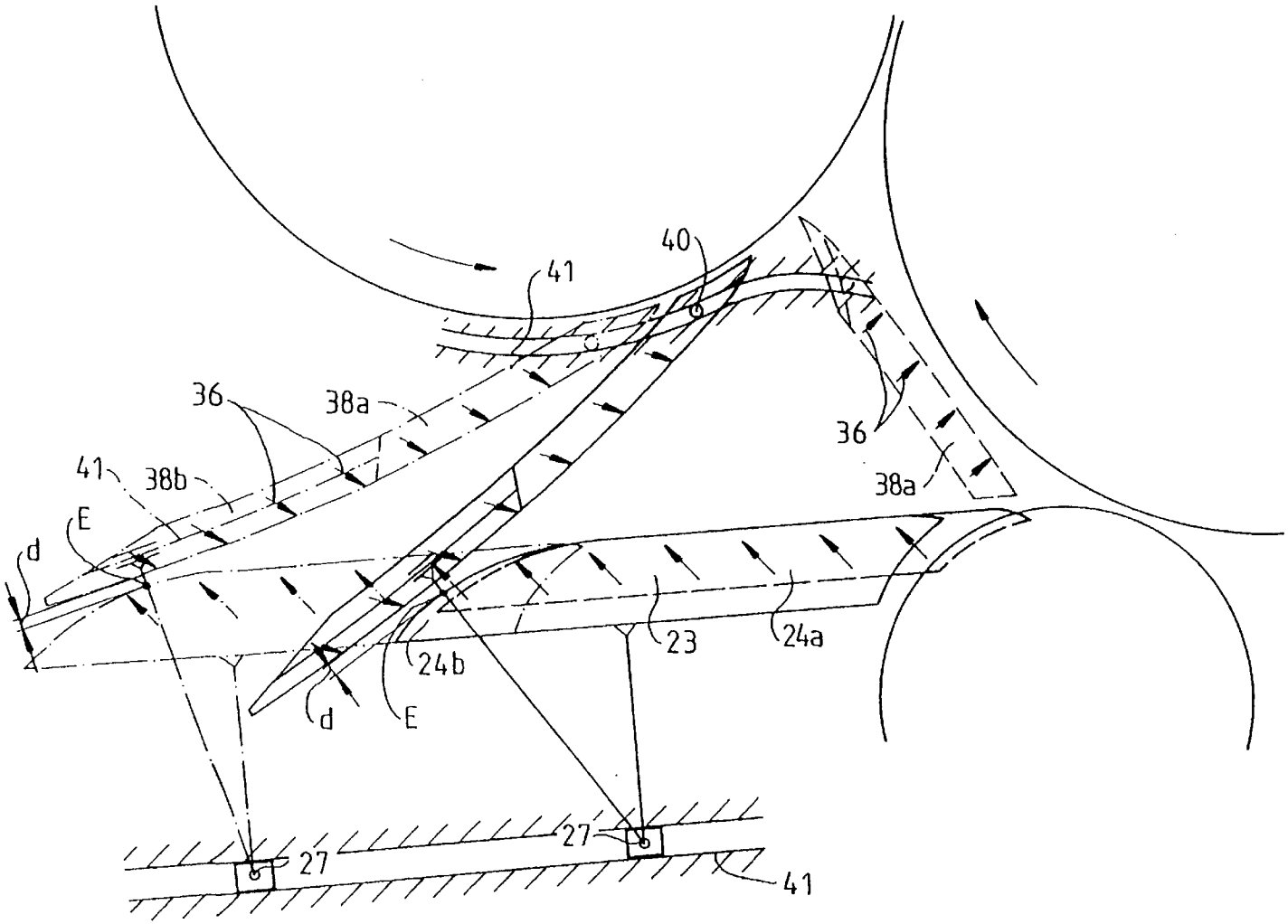
FIG. 7 is an enlarged fragmentary view of FIG. 2 showing in further detail a preferred embodiment of an intermediate storage system according to the invention.
Figure 8:
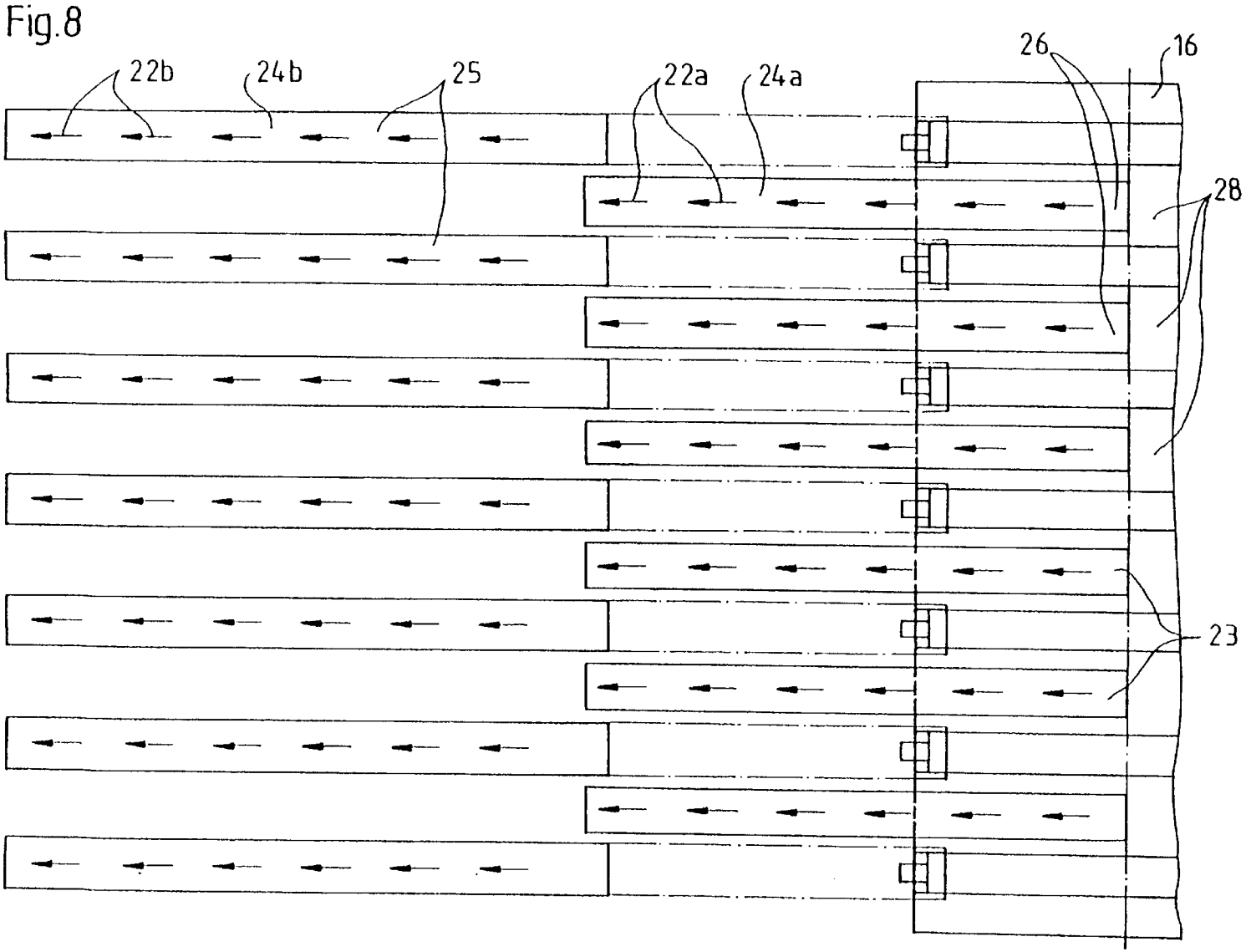
FIG. 8 is an enlarged fragmentary diagrammatic plan view of the intermediate storage system of FIG. 7.

In the preferred embodiment of the invention, a second sheet guiding device 38 is also provided below the second impression cylinder 6, as shown for example in FIG. 1 and FIG. 2. The second sheet guiding device 38 is preferably likewise provided with blower nozzles 36 which, due to a tangential blowing direction with regard to the sheet guiding plane generate both a blowing and a suction action, by the so-called "hydrodynamic paradox", and by which the sheet 10 is forced by suction so far that it is lifted from the first sheet guiding device 24 and moved into a stable floating position above the second sheet guiding device 38 wherein the sheet 10 does not engage the second sheet guiding device 38. While the trailing edge of the sheet 10 is being lifted by the tongs-type turning gripper device 30, and the leading edge of the sheet 10 reaches the range of influence of the second sheet guiding device 38, an automatic lifting of the sheet from the first sheet guiding device 24 and a transfer of the sheet 10 into a stable, contactfree floating position above the second sheet guiding device 38 is thus effected in the region of the leading edge of the sheet. As a result, the turned-over sheet 10 is lifted uniformly from the leading to the trailing edge thereof and is brought into a plane from which it is then pulled towards the downline impression cylinder 6 by the tongs-type turning gripper device 30, without the influence of centrifugal forces. As shown in FIGS. 7 and 8, in the preferred embodiment of an intermediate storage system 19 according to the invention, the first sheet guiding device 24 is formed of a first subsystem or partial system 24*a* and a second subsystem or partial system 24*b*. The first subsystem 24*a* is formed of float strips 23, shown in FIG. 8, which are provided with blower or blast nozzles 22*a* and which, in the front or leading region thereof, simultaneously form the comblike protrusions 26 which engage in associated grooves or notches 28 formed in the register cylinder 16.

The second subsystem 24*b* is preferably likewise formed of strips 25 which, in a comblike or fingerlike manner, engage in the interstices between the float strips 23 of the first subsystem 24*a*. The second subsystem 24*b* may be provided with blower nozzles 22*b* in the same manner as the first subsystem 24*a* and as is suggested for example in FIG. 8 by a few blower nozzles 22*b*, shown by way of example. The second subsystem 24*b* is preferably rounded at a rear or trailing end portion thereof, so as to create a transition to the second sheet guiding device 38 in such a form that the rounding is tangent to a plane parallel to the surface of the second guiding device 38 at the spaced distance d, as shown for example in FIG. 7.

In the preferred embodiment of the invention, the second subsystem 24*b*, in contrast with the first subsystem 24*a* of the sheet guiding device 24, is preferably constructed so as to be displaceable by motor, so that sheets 10 of different format lengths always rest with the leading edge thereof on the reference point E of the rounding on the end portion of the second subsystem 24*b*, while the trailing edge of the sheet is engaged by the tongs-type turning gripper device 30. In the preferred embodiment of the invention, the sheet guiding device 38 is disposed movably so that, for setting paper format or size, it is, on the one hand, pivotable about the downline impression cylinder 6, without materially changing the tangential transition of the guidance plane thereof to the impression cylinder 6 and, on the other hand, in such a pivoting motion, a parallel to the sheet guidance plane of the second sheet guiding device 38 is virtually always tangent to the runout curvature of the end portion of the second subsystem 24*b* at the reference point E and at the spaced distance d.

In this manner, sheets of all formats or sizes, regardless of the length thereof, are lifted and turned over by the leading and trailing edges thereof with identical functions.

In the preferred embodiment of the invention, an adjusting transmission 27 may be provided, such as is shown for example in FIG. 7, which simultaneously executes a displacement of the subsystems 24*a* and 24*b* and at the same time adjusts the second sheet guiding device 38 so that, depending upon the sheet length, the device 38 is always disposed in a manner that the aforementioned spaced distance d between the curvature of the end portion of the second subsystem 24*b* and the surface or guide face of the second sheet guiding device 38 is maintained without change.

The second sheet guiding device 38 may preferably be formed by a first subsystem 38*a* disposed in the vicinity of the downline impression cylinder 6, and a second subsystem 38*b* that is movably disposed, in contrast with this first subsystem 38*a*. The first and second subsystems 38*a* and 38*b* of the second sheet guiding device are constructed in such a manner, in the preferred embodiment of the invention, that beginning at the position for the shortest sheet length to be selected, the first subsystem 38*a* is still pivotable, preferably by the adjusting transmission 27, even if the second subsystem 38*b* and the subsystems 24*a* and 24*b* of the first sheet guiding device 24 have already assumed their runout position. To that end, rollers 40 are provided on both sides of the second subsystem 38*a* and are guided in a corresponding curved path 41 disposed below the downline impression cylinder 6, as shown diagrammatically in FIG. 7. Provision may also be made for the first subsystem 38*a* of the second sheet guiding device 38 to be rounded in the region below the downline impression cylinder 6, as shown for example in FIG. 7.

During one-sided or first-form printing by the printing press, wherein no sheet turn-over takes place, the first sheet guiding device 24 and the subsystem 38*b* are moved towards one another to the shortest sheet length by the adjusting transmission 27, and the first subsystem 38*a* is moved still farther, into the one-sided or first-form printing position represented by dot-dash lines or in phantom in FIG. 7, through the intermediary of the cam rollers 40 along the curved path 41. In this position, the blower/suction nozzles 36 of the second sheet guiding device 38 are directed towards the circumferential surface of the transfer drum 2 and, as a result, especially in the region of the end thereof, the sheet 10 is guided stably and without fluttering. By this type of guidance of the sheet 10 reinforced with blown air, wherein the quantities of blown air from the blown air nozzles 36 are preferably adjustable, the sheet 10 is guided without fluttering even at high printing press speeds in one-sided or first-form printing, and damage to the end of the sheet is avoided. Both the first sheet guiding device 24 and the tongs-type turning gripper device 30 of the register cylinder 16 are deactivated during the one-sided or first-form printing, in the preferred embodiment of the invention. It may also be advantageous, during one-sided or first-form printing, to subject the recess 218 and/or the recess 224 and/or the recess 226 with blown air or with negative pressure, in order to achieve better sheet guidance in the region of the register cylinder.

The sheet guiding devices 24 and 38, in another non-illustrated embodiment of the invention, may be formed in the same manner by rollers defining a flat surface whereon the sheet is moved along.

It is also conceivable to construct the first sheet guiding device 24 in the form of revolving suction belts moving at the circumferential speed of the register cylinder 16, the sheets being held on the belts by suction, and carried along In-register. The suction belts may be embodied either as continuous suction belts, or similarly to the subsystems 24*a* and 24*b*, as suction belts extending offset from one another downline of the register cylinder 16, or alternatively, they may be a plurality of suction belts extending parallel and side-by-side and wrapped around the register cylinder 16, the belts being guided in corresponding grooves formed in the register cylinder 6. Provision may also be made for a non-illustrated chain gripper system to be located in the region of the first sheet guiding device, for guiding the leading edge of the sheet onwardly, in-register, after the sheet has been taken over from the register cylinder 16 or from the transfer drum 2.

The intermediate storage system 1 is not limited to use in a turning device with a register cylinder according to the invention; instead, it can also be used in a conventional turning device known in the prior art.

Figure 3:
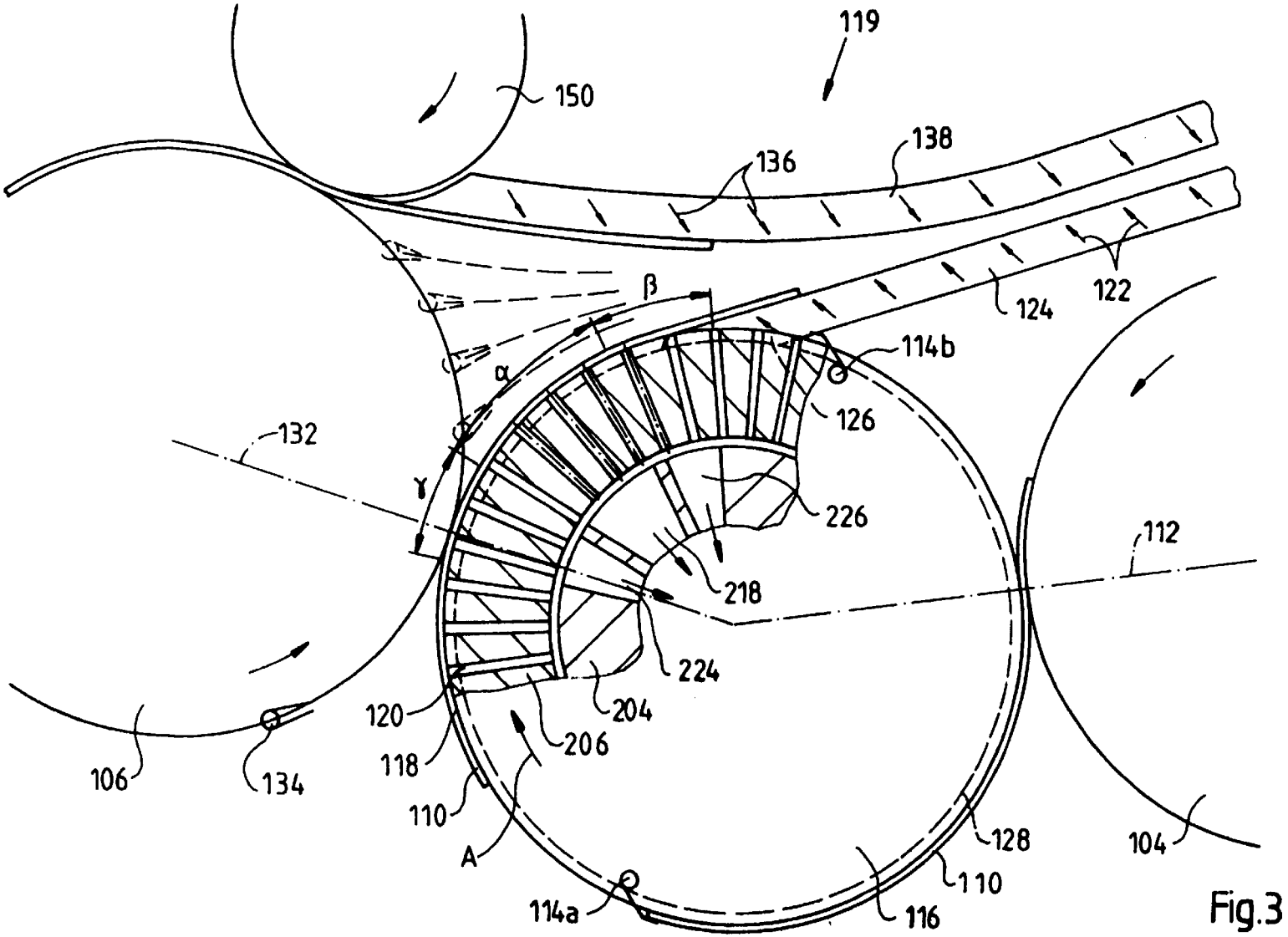
FIG. 3 is a diagrammatic and schematic side elevational view of a second embodiment of the turning device according to the invention, with a register cylinder disposed between an upline impression cylinder and a downline impression cylinder and with an intermediate storage system disposed above the register cylinder.
Figure 4:
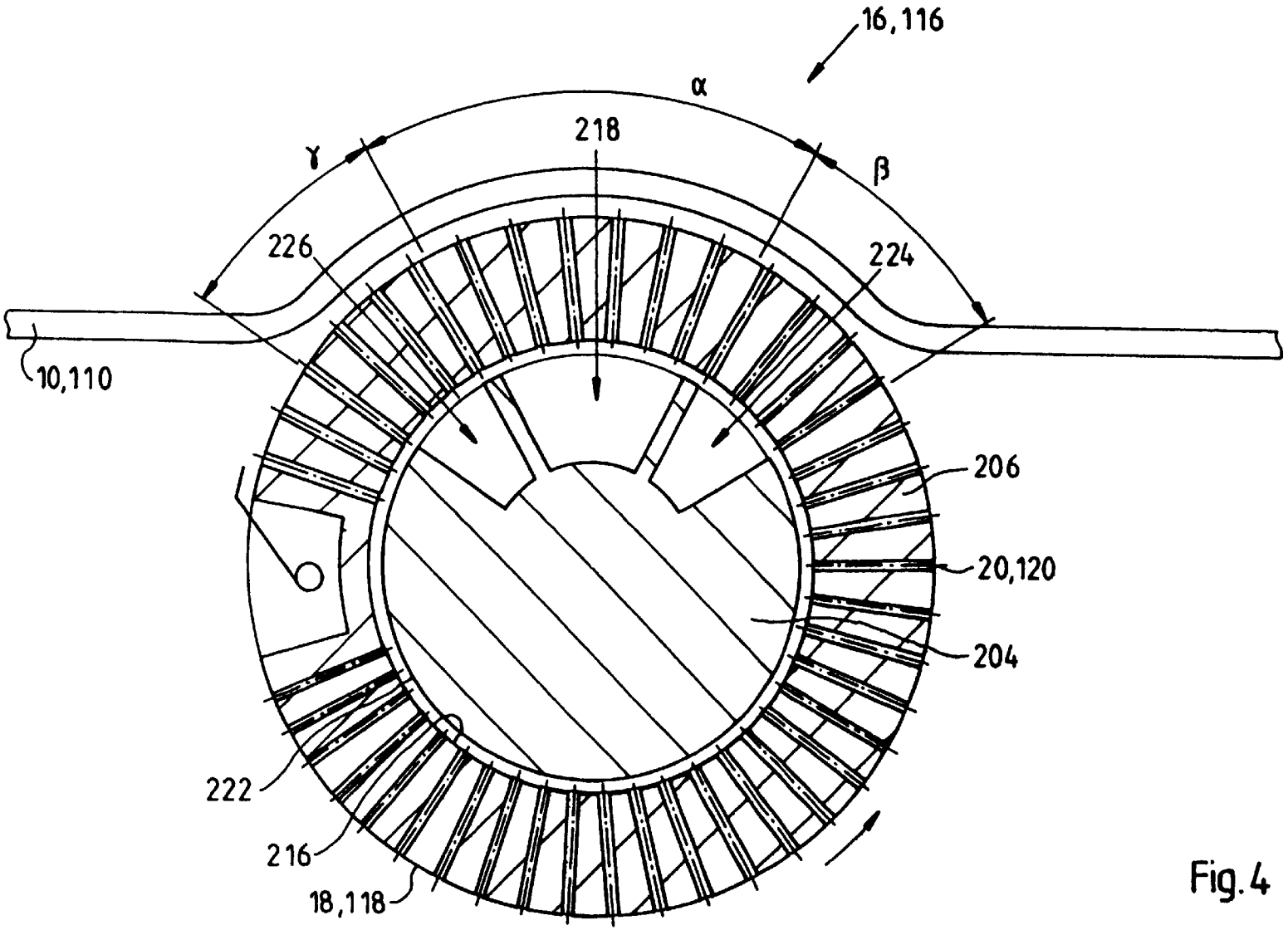
FIG. 4 is a cross-sectional view of a register cylinder with a gripper device.

In a further embodiment of the invention shown in FIG. 3, wherein parts corresponding to those in the embodiment described hereinbefore are identified by reference numerals which have been increased by 100, the register cylinder 116 is disposed directly between the first impression cylinder 104 and the second impression cylinder 106. In this embodiment of the invention, the transfer drum 2 of the previously described embodiment of the invention is accordingly omitted. In this embodiment of the invention, the register cylinder 116 is preferably embodied as a double-sized cylinder. However, it may also have some other size, for example, it may be embodied as a triple, quadruple or quintuple-sized cylinder.

The embodiment of the invention will now be described in terms of a double-sized register cylinder 116. The double-sized register cylinder 116 has two conventional gripper devices 114*a* and 114*b* facing one another, which in a conventional manner accept the sheet 110 from the upline impression cylinder 104 in a known manner and hold it by its leading edge and guide it in-register until it reaches the central gripper area 132. After passing through the central gripper area 132, the sheet 110 reaches the circumferential surface portions α, β and γ and is then guided onward in-register by the action of suction and frictional forces. The respective gripper device 114*a* and 114*b* of the register cylinder 116 opens and transfers the leading edge of the sheet to an intermediate storage system 119, which is disposed above the register cylinder 116 and has a first sheet guiding device 124, occupied by blower nozzles 122, whereon the device 110 is guided in a floating manner, this time with the printed side thereof facing downwardly. In the same manner as for the sheet guiding device 24 of the previous embodiment, the sheet guiding device 124 can have protrusions 126, which engage in corresponding grooves 128, represented by a broken line, which are formed in the circumferential surface 118 of the register cylinder 116. In addition, above the first sheet guiding device 124, a second sheet guiding device 138 may be provided, which applies blown air to the top of the sheet 110 via blower/suction nozzles 136. The sheet guiding devices 124 and 138 may be provided, in a manner analogous to that of the aforedescribed sheet guiding devices 24 and 38, with corresponding size adjusters, and roller and/or chain gripper devices, or may be formed by such elements; there is additionally the possibility that the lower, first sheet guiding device 124 may be embodied as, or include, a suction belt of the type described hereinabove.

In the same manner as for the register cylinder 16 of the first embodiment described above, the register cylinder 116 has a circumferential surface 118, which is provided with suction openings 120 and onto which the sheet 110 is forced by suction and held thereon. By the rotation of the register cylinder 116, the sheet 110 forced by suction onto the circumferential surface 118 is guided in-register, after the gripper devices 114*a* and 114*b* have opened, by the register cylinder 116 into the intermediate storage system 119, the sheet 110 being moved, with the printed side thereof facing downwardly, on an air cushion above the first sheet guiding device 124. The instant the trailing edge of the sheet has passed the central gripper area 132, it is engaged by a conventional tongs-type turning gripper device 134 of the second downline impression cylinder 106. The tongs-type turning gripper device 134 then lifts the sheet 110, beginning at the trailing edge thereof, from the circumferential surface 118 of the register cylinder 116, as indicated by the broken lines in FIG. 3, and guides the turned-over or inverted sheet 110, with the trailing edge thereof in the lead, to the printing nip of the downline printing unit, where the rear side of the sheet 110 is printed.

Figure 5:
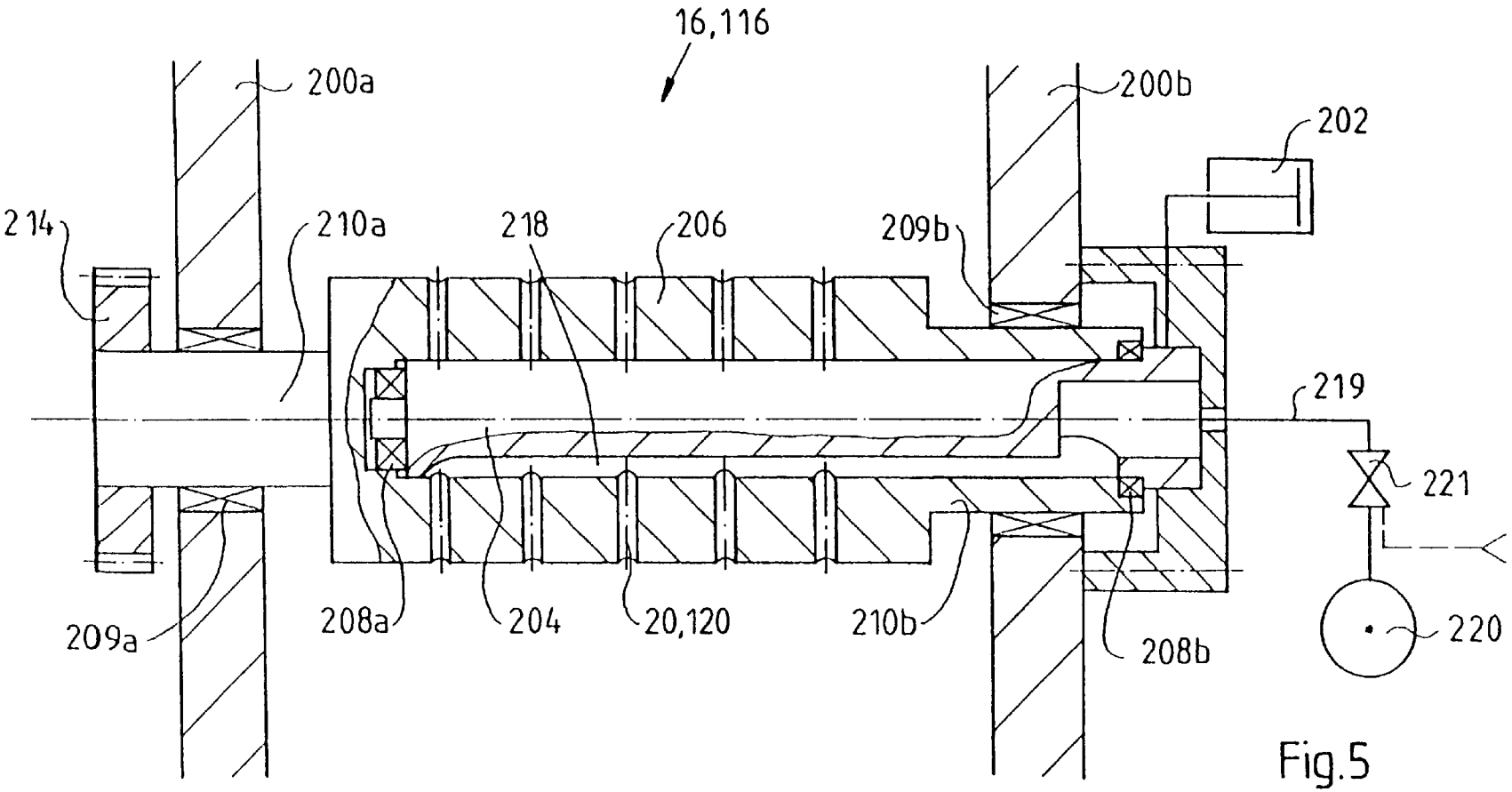
FIG. 5 is a diagrammatic and schematic longitudinal sectional view of the register cylinder of FIG. 4.
Figure 6:
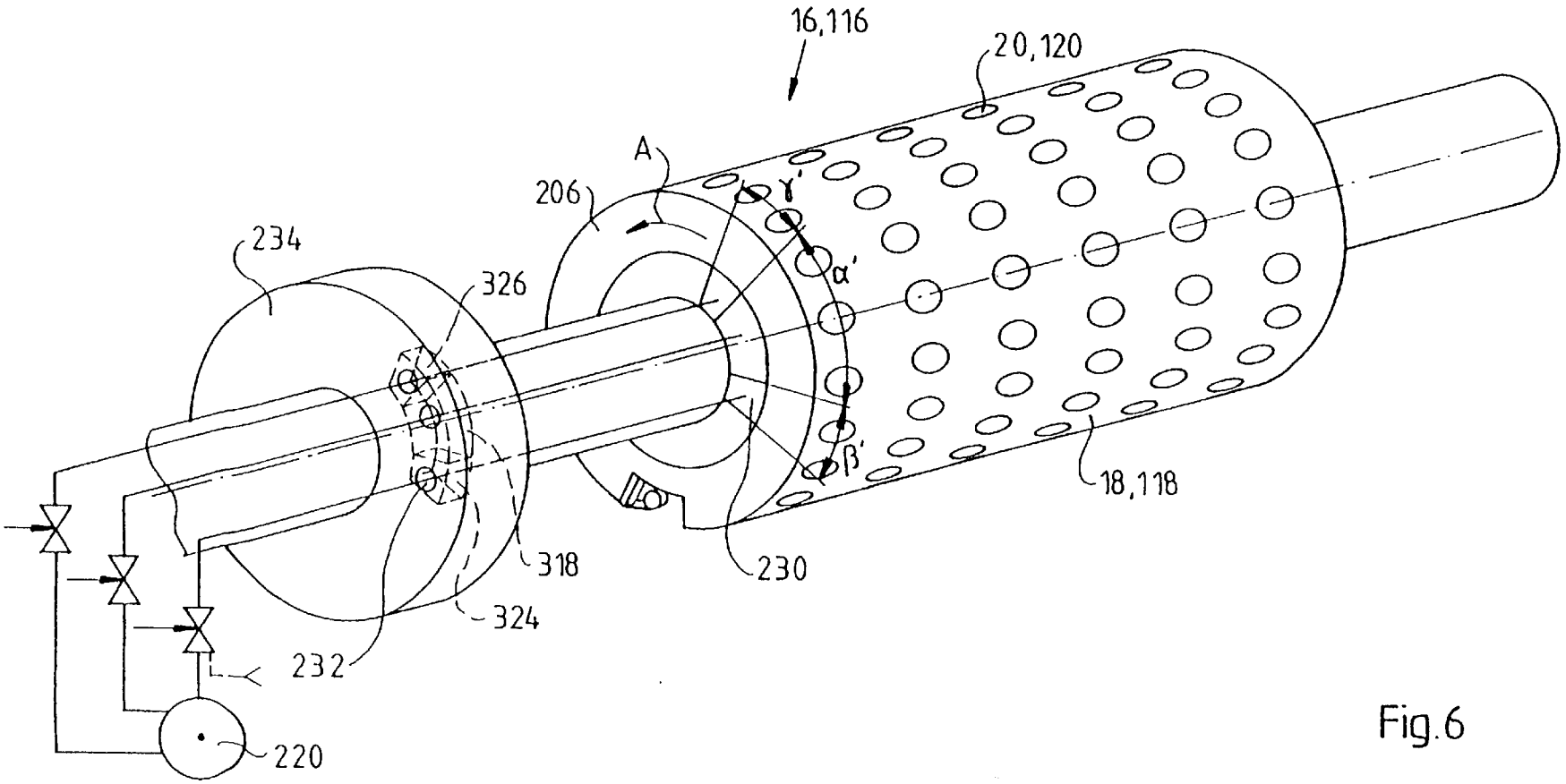
FIG. 6 is a diagrammatic and schematic perspective view of another embodiment of the register cylinder, wherein the suction openings communicate with a negative pressure source via a rotary valve disposed on an end face of the cylinder.

Described hereinafter is a preferred embodiment of a register cylinder of the type that can be used for example in the embodiments of FIGS. 1 and 2 or the embodiment of FIG. 3. The register cylinder 16, 116 shown in cross section in FIGS. 4 and 5 has a core 204, which is supported in stationary manner facing the side wall 200*a*, 200*b* of the printing press, or rotatably by a pneumatic or electrical adjusting device 202, and a substantially hollow-cylindrical jacket or jacket body 206 which is freely rotatable about the core via bearings 208*a* and 208*b*. The jacket body 206 may, for example, as shown in FIG. 5, be supported via journals 210*a* and 210*b* and cylinder bearings 209*a* and 209*b* in the side walls 200*a* and 200*b* of the printing press and be driven in a conventional manner via the journal 210*a* and a driving gear wheel 214. As shown in FIGS. 1 to 6, suction openings 20, 120 are formed in the jacket body 206 of the register cylinder 16, 116, extending radially outwardly from the inner wall 216 of the jacket body 206 to the circumferential surface 18, 118, by way of these openings, the sheet 10, 110 being subjected to suction so that they are held on the circumferential surface 18, 118. In the preferred embodiment of the invention, the circumferential surface 18, 118 preferably has a roughened structure, which increases the friction between the sheet 10, 110 and the circumferential surface 18, 118, which in turn leads to improved registration accuracy as the sheet 10, 110 is being transported into the intermediate storage system 19, 119.

In the preferred embodiment of the register cylinder 16, 116, the core 204 is formed with one or more recesses 218, which communicate with a negative pressure source 220 via a line 219 and a valve 221, and which can be ventilated with ambient air, as suggested by the broken lines in FIG. 5. The suction openings 20, 120 which are located above the recess 218 and which communicate with the recess 218 are accordingly acted upon by suction from the negative pressure source 220. Conversely, the other suction openings 20, 120, which do not communicate with the recess 218, are closed by the outer circumferential surface 222 of the core 204, and so they are no longer acted upon by suction.

Upon a rotation of the jacket body 206 of the register cylinder 16, 116 in the direction of the arrow A, the sheet 10, 110 is subjected to suction solely in the portion marked α,β or γ of the circumferential surface 18, 118, in which the suction openings 20, 120 communicate with the recess 218.

In the preferred embodiments of the invention, in addition to the recess 218, further recesses 224 and 226 are provided, upstream and/or downstream in the direction of rotation A of the register cylinder 16, 116; they are separated from the recess 218 by otherwise unidentified partitions. The recesses 224 and 226 can preferably be acted upon by a different pressure from the recess 218. For example, in the exemplary embodiments of FIGS. 1 and 2, it is advantageous if a negative pressure is also generated in the upstream recess 224 during the in-register transportation of the sheet 10, so that the sheet 10 is subjected to suction in the associated circumferential surface portion β. The negative pressure may then be less than, equal to or greater than the negative pressure in the recess 218. Once the sheet 10 has been fed almost all the way into the intermediate storage system 19, the recess 224 can be ventilated via a non-illustrated valve either before or while the tongs-type turning gripper device 30 of the transfer drum 2 engages the trailing edge of the sheet and lifts the sheet 10 from the register cylinder 16. As a result, the suction fed to the sheet is advantageously cancelled as the trailing edge of the sheet is lifted from the register cylinder 16 and, as a result, the sheet 10 can be released more easily from the circumferential surface 18, 118 of the register cylinder. Because of the lifting of the rear edge of the sheet from the portion β of the circumferential surface 18, the effect additionally arises that by the uncovering of the suction openings 20, below the sheet 10, an automatic ventilation of the recesses 224, 218 and 226 takes place, so that even without additional external ventilation of the recesses, the sheet 10 can easily be lifted from the circumferential surface 18 of the register cylinder 16. In order to maintain the negative pressure in the recesses 218, 224 and 226 even when narrow sheet sizes or formats are being handled, the suction openings 20, 120 laterally of the sheet 10 are in this case covered, for example by a cuff, sleeve or band, or closed in some other way, or for example turned off by valves.

Provision may also be made for the recess 226 to be also acted upon by a negative pressure that is reduced, the same as or increased in comparison with that of the recess 218, or optionally with blown air as well. Thus, it is advantageous, for example, if during in-register sheet transport the negative pressure in the recess 226 is somewhat less than the negative pressure in the recess 218, so that the sheet in the region γ of the circumferential surface 18, 118 of the register cylinder 16, 116 is not subjected to suction as strongly as against the circumferential surface 18, 118 and can be released from the suction more easily. The instant the sheet 10, 110 has been thrust into the intermediate storage system 19, and the tongs-type turning gripper device 30 lifts the trailing edge of the sheet, or the sheet per se, from the portions α,β and γ of the circumferential surface 18, 118, the recess 226 is preferably ventilated by a non-illustrated valve, or even acted upon by blown air. The recess 218 and/or the recess 224 can also be acted upon by blown air while the trailing edge of the sheet is being lifted by the tongs-type turning gripper device 30. It is also possible for the recess 226 to be ventilated permanently, in order to fill the evacuated suction openings 20, 120 in the circumferential surface 18, 118 with air in such a way as to allow separation of the sheet.

In the same manner, the register cylinder 116 in the embodiment of the invention shown in FIG. 3 can also be provided in a corresponding manner with recesses 218, 224 formed in the core 204, which are assigned to corresponding circumferential surface portions α, β and γ. In this embodiment of the invention, while the leading edge of the sheet 110 is being introduced into the intermediate storage system 119, all the portions α, β and γ can be acted upon with negative pressure, especially once the gripper device 114 has released the leading edge of the sheet, so that large-area subjection of the sheet to suction against the circumferential surface 118 of the register cylinder 116 is assured. Once the end of the sheet has passed through the central gripper area 132 and the tongs-type turning gripper device 134 of the downline impression cylinder 106 has gripped the trailing edge of the sheet, in the preferred embodiment, the supply of suction to the recesses 218 and 226 is discontinued, or the recesses 218, 226 are ventilated or optionally acted upon by blown air, so that in the portions α and β, suction of the sheet 110 onto the circumferential surface 118 of the register cylinder 116 no longer occurs. As a result, and because of the successive uncovering of the suction openings 120 in the circumferential surface portion α, which necessarily leads to ventilation and thus to a reduction of the negative pressure in the recess 218, the sheet can be lifted from the register cylinder 116 by the tongs-type turning gripper device 134 in a gentle manner, without excessive stress.

I claim:

1. A turning device for a printing press, wherein a sheet printed on one side thereof is acceptable from an impression cylinder of an upline printing unit and is transferable to an impression cylinder of a downline printing unit, comprising a first gripper device for accepting the sheet by a leading edge thereof from the upline impression cylinder, a register cylinder formed with a multiplicity of suction openings distributed over a circumferential surface thereof and being communicable with a negative pressure source for holding the sheet by suction and for guiding the sheet in-register with a leading edge thereof in the lead, the sheet, while being guided in-register, being held solely by said suction openings, and a second gripper device for accepting the sheet from said register cylinder at a trailing edge of the sheet.

2. The turning device according to claim 1, including an intermediate storage system to which the sheet is transferrable, with the leading edge thereof leading, from said register cylinder.

3. The turning device according to claim 1, including a control device for connecting the suction openings located in a predetermined circumferential surface portion of said register cylinder to said negative pressure source.

4. The turning device according to claim 3, wherein said circumferential surface portion is capable of assuming a substantially fixed spatial position with respect to the printing press.

5. The turning device according to claim 3, wherein said control device includes a stationary, substantially cylindrical core formed with a recess subjectible to action by negative pressure, and a cylinder jacket rotatable about said stationary core and formed with radial through-bores.

6. The turning device according to claim 5, wherein said jacket forms said circumferential surface of said register cylinder, and said radial through-bores communicate with said suction openings.

7. The turning device according to claim 5, wherein said cylindrical core is rotatable.

8. The turning device according to claim 3, wherein said control device is formed by a rotary valve disposed on an end face of said register cylinder and connecting said suction openings alternatively with said negative pressure source via chambers disposed in the interior of said register cylinder.

9. The turning device according to claim 3, wherein said control device is formed by valves triggerable individually and/or in groups and assigned to said suction openings.

10. The turning device according to claim 1, wherein said register cylinder has a roughened surface.

11. The turning device according to claim 3, wherein said circumferential surface portion of said register cylinder is subdivided into further portions separately connectable to said negative pressure source and/or ventilatable.

12. The turning device according to claim 2, wherein said intermediate storage system has a first sheet guiding device communicating with said register cylinder, and is formed of two subsystems having strips meshing in comblike manner with one another.

13. The turning device according to claim 12, wherein at least one of said subsystems has blower nozzles.

14. The turning device according to claim 12, wherein one of said subsystems has a rounded end portion.

15. The turning device according to claim 14, including a second sheet guiding device disposed between said end portion of said one subsystem and said downline impression cylinder.

16. The turning device according to claim 15, wherein said second sheet guiding device is formed by two subsystems meshing with one another in comblike manner, at least one of said subsystems being provided with blower nozzles extending in substantially the direction of said first sheet guiding device.

17. The turning device according to claim 15, wherein said second sheet guiding device is formed of first and second subsystems, respectively, with closed surfaces aligned with one another and with blower nozzles let into said surfaces, said first and second subsystems being movable separately and independently of one another along a line parallel to a central axis of said register cylinder.

18. The turning device according to claim 15, wherein said second sheet guiding device has a surface disposed at a spaced distance from said rounded end portion of said first sheet guiding device so that the leading edge of the sheet, on entering said end portion, is lifted by said first sheet guiding device and held by suction by said second sheet guiding device.

19. The turning device according to claim 18, including an adjusting device which, upon an adjustment in sheet format, serves to push said first and second subsystems of said first sheet guiding device and said first subsystem and said second subsystem of said second sheet guiding device towards one another so that said spaced distance between said surface of said second sheet guiding device with respect to a reference point on said rounded end portion of said second subsystem of said first sheet guiding device is kept substantially unchanged.

20. The turning device according to claim 19, wherein said adjusting device includes rollers provided on said first subsystem of said second sheet guiding device, said rollers being guidable in a curved path.

21. The turning device according to claim 17, including a transfer drum located between the upline and the downline impression cylinders, and wherein said first subsystem of said second sheet guiding device, during first form and perfecter printing by the printing press, is movable into a position wherein said blower nozzles extend in the direction of the surface of the transfer drum.

22. The turning device according to claim 15, including rollers whereon the sheet is guidable, said rollers being provided on at least one of said first and said second sheet guiding devices.

23. The turning device according to claim 15, wherein said first sheet guiding device includes a suction belt subjectible to suction, whereon the sheet rests.

24. The turning device according to claim 23, wherein said suction belt is drivable at a speed substantially equivalent to the circumferential speed of said register cylinder.

25. The turning device according to claim 2, wherein said intermediate storage system includes at least one gripper device for gripping the sheet by the leading edge thereof and guiding the sheet in-register.

26. A turning device for a printing press, having a transfer device disposed between an impression cylinder of a printing unit located upline of the transfer device and an impression cylinder of a printing unit located downline of the transfer device, the transfer device including a first gripper device for accepting a sheet from the impression cylinder of the upline printing unit and including a second gripper device for gripping a trailing edge of the sheet and transferring it to the impression cylinder of the downline printing unit, comprising a register cylinder disposed near the transfer device and being formed with a multiplicity of suction openings distributed over a circumferential surface thereof, said suction openings being communicable with a negative pressure source for holding the sheet by suction and guiding the sheet in-register with a leading edge thereof leading, the sheet, while being guided in-register, being held solely by the suction openings, before the second gripper device grips the trailing edge of the sheet.

27. The turning device according to claim 26, including a further gripper device provided on said register cylinder for accepting the sheet in-register by the leading edge thereof before the sheet is forced by suction onto said circumferential surface.

28. A turning device for a printing press, wherein a sheet printed on one side thereof is acceptable from an impression cylinder of an upline printing unit and is transferable turned-over to an impression cylinder of a downline printing unit, comprising a register cylinder having a gripper device disposed thereon for accepting the sheet by a leading edge thereof from an immediately upline impression cylinder and for turning the sheet over, said register cylinder being formed with a multiplicity of suction openings distributed over a circumferential surface thereof and being communicable with a negative pressure source for holding the sheet by suction and guiding the sheet in-register with a leading edge thereof leading, the sheet, while being guided in-register, being held solely by said suction openings, and having a gripper device disposed on the impression cylinder of the downline printing unit for accepting the sheet from said register cylinder at the trailing edge of the sheet.

* * * * *